United States Patent [19]

Lickle

[11] Patent Number: 4,981,098

[45] Date of Patent: Jan. 1, 1991

[54] HARNESS RELEASE DEVICE FOR WATER SKIING

[76] Inventor: Brett Lickle, 115 Lua Hine Pl., Haiku, Hi. 96708

[21] Appl. No.: 530,615

[22] Filed: May 30, 1990

[51] Int. Cl.[5] ..... A63C 11/10

[52] U.S. Cl. ..... 114/253; 441/69

[58] Field of Search ..... 114/253; 441/69; D21/228, 229, 230, 236; 182/2, 5

[56] References Cited

U.S. PATENT DOCUMENTS

| | | | |
|---|---|---|---|
| 2,721,088 | 10/1955 | Ritter, Jr. | 114/253 |
| 3,021,513 | 2/1962 | Lankey | 441/69 |
| 3,051,118 | 8/1962 | Calk et al. | 441/69 |
| 3,324,818 | 6/1967 | Dunlap | 441/69 |
| 3,494,319 | 2/1970 | Dunlop | 441/69 |
| 4,235,182 | 11/1980 | Burger | 440/34 |
| 4,263,685 | 4/1981 | Neuscheler | 441/69 |
| 4,280,240 | 7/1981 | Neuscheler | 441/69 |
| 4,651,351 | 3/1987 | Endo et al. | 182/5 |
| 4,867,722 | 9/1989 | Joseph | 441/69 |

*Primary Examiner*—Joseph F. Peters, Jr.
*Assistant Examiner*—Edwin L. Swinehart
*Attorney, Agent, or Firm*—Watson, Cole, Grindle & Watson

[57] ABSTRACT

A harness release device for water skiing is disclosed and includes a handle with a longitudinal bore there through. A first end of a harness line is fixedly received within the bore at one end of the handle while the second end of the harness line is releasably received within the bore at the other end of the handle. A clamping element is provided, and is maintained in engagement with the second end of the harness line by hand pressure of a water skier, and release of such pressure allows disengagement of the clamping element, and the subsequent release of the second end of the harness line from within the bore of the handle.

18 Claims, 2 Drawing Sheets

HARNESS RELEASE DEVICE FOR WATER SKIING

BACKGROUND OF THE INVENTION

The invention relates to a harness release device for use by water skiers being towed by a motor boat, jetski, or any other suitable means. The skier normally grasps a handle with his hands, the handle being attached to the usual tow line. Such skiers commonly wear a harness which can be connected by suitable connecting means to the handle. The pull of the tow line is normally transferred to the skier through the skiers arms. However, when the arms become tired, the skier can connect the harness to the handle by a connecting means so that the pull of the tow rope is transferred to the skier through the connecting means and the harness.

It is desirable to provide means for readily releasing the harness from the handle, as for example when the skier falls into the water, to prevent the skier from being dragged through the water by the boat. Various devices have been employed for this purpose. Some devices employ the hands of the skier to control the release of the harness from the handle. This type of device may employ the hands of the skier to retain the operative connection between the handle and the harness. The skier can cause release of the connection by movement of the hands, thereby ensuring that the operative connection is disconnected when desired.

Prior art harness release devices employ relatively complex mechanical arrangements which may be subject to failure in use.

SUMMARY OF THE INVENTION

A principal purpose of the invention is to provide a harness release device construction which is simple, yet which is effective and reliable in operation. The invention employs a harness line having one end thereof fixedly secured to the handle so that it cannot move away from the handle, the opposite end of the harness line being releasably secured to the handle. An intermediate portion of the harness line may be connected to a skier's harness. The opposite end of the harness line is clamped to the handle by a clamping means which is pivotally supported by the handle. This clamping means is pivoted inwardly into clamping position by a hand of the skier when grasping the handle.

As long as the skier applies pressure to the clamping means by grasping the handle, the releasable end of the harness line is held against movement away from the handle. Upon release of pressure on the clamping means by the skier, the releasable end of the harness line can move away from the handle and release the harness from the handle and the tow line.

The desired end result is obtained in a most simple manner, minimizing the number of moving parts, and enabling release of the harness from the handle and the tow line as a natural consequence of the forces applied to the various parts of the device.

DESCRIPTION OF THE PREFERRED EMBODIMENTS

Figures 1, 2, 3:
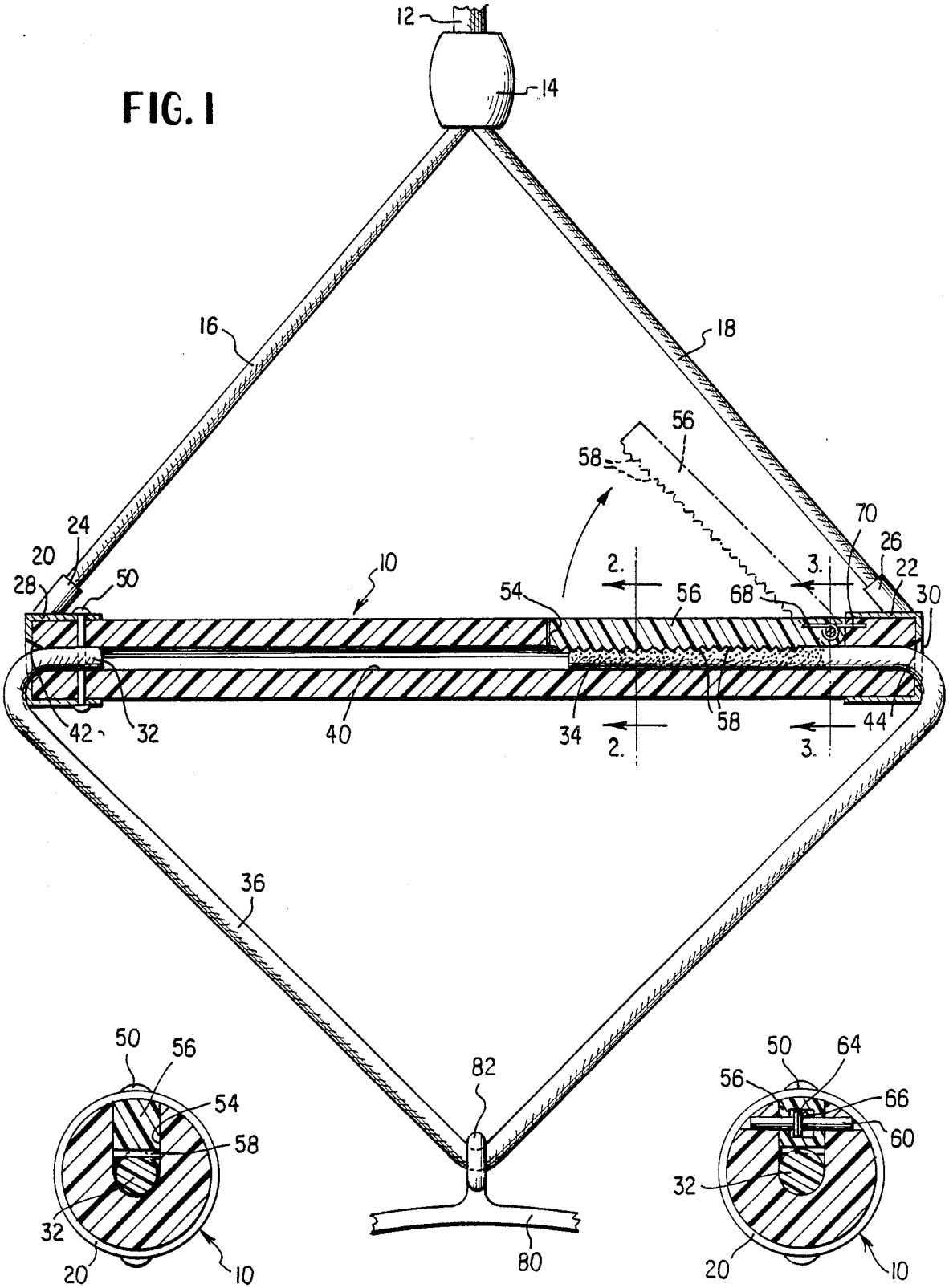
FIG. 1 is a top view, partly in section, of a first form of the invention.
FIG. 2 is a sectional view on an enlarged scale taken along line 2—2 of FIG. 1 looking in the direction of the arrows.
FIG. 3 is a sectional view on an enlarged scale taken along line 3—3 of FIG. 1 looking in the direction of the arrows.

Referring now to the drawings wherein like reference characters designate corresponding parts throughout the several views, a first form of the invention is shown in FIGS. 1–3 wherein a substantially rigid cylindrical handle formed, for example, of plastic material is indicated generally by reference numeral 10. The handle may also be formed of metal or other rigid material if desired. The water skier normally grasps the handle with both hands to be towed by a power boat.

The boat has a ski tow line 12 connected thereto, the rear portion of the tow line being connected at a fitting 14 to a pair of yoke lines 16 and 18 which are in turn connected to the opposite ends of the handle. The tow line and the yoke lines may be formed of any suitable material such as rope or braided Nylon or the like. The yoke lines may be connected in any suitable conventional manner to the handle, the connections being shown as a pair of cup shaped members 20 and 22 connected to opposite ends of the handle and including fittings 24 and 26 respectively which are fixed to the rear ends of yoke lines 16 and 18. Cup shaped members 20 and 22 are provided with central openings 28 and 30 respectively for receiving opposite end portions 32 and 34 of a harness line 36.

The handle has a central bore 40 extending longitudinally thereof and opening at opposite ends of the handle. The opposite ends of the bore wall taper outwardly at 42 and 44 so as to facilitate entry of the opposite end portions of the harness line into the bore. The harness line 36 may be formed of material similar to that of the tow line and yoke lines, or of other materials such as plastic covered cable. End portion 32 of the harness line is fixedly secured to the handle by a securing means in the form of a headed pin member 50 which passes through the end portion of the harness line so that the end portion of the harness line cannot move out of the bore in the handle and away from the handle. Any suitable means may be employed for securing this end of the harness line in position within the bore.

The opposite end portion 34 of the harness line is slidably positioned within the opposite end of the bore and is preferably treated so as to be substantially stiffer than the remaining portion of the harness line. However, end portion 34 may not be so treated, if desired. When it is desired to provide a stiffer end portion, it may be impregnated with a plastic material as indicated by the stippling on FIG. 1. This facilitates entry of this end of the harness line into operative position within the bore of the handle, and further cooperates with the clamping means hereinafter described to provide a good clamping action in combination with the clamping means.

A longitudinal slot 54 is formed in the handle, the slot being in communication with bore 40. A clamping means 56 comprises an elongated member which fits within the slot with sufficient clearance to permit free movement of the clamping means. Member 56 may be formed of plastic or metal, for example, and is provided with a plurality of spaced clamping portions 58 thereon which may be in the form of tooth-like members having sharp outer edges adapted to engage the end portion 34 of the harness line and effectively clamp and hold the end of the harness line between the clamping member and the wall of bore 40 within the handle.

Clamping member 56 is pivotally supported by the handle for pivotal movement into and out of clamping position so as to engage or to move out of engagement with the end of the harness line. A pivot pin 60 is fitted within aligned bores in the handle and the clamping member so that the clamping member can pivot between the clamping position shown in full lines and the released position shown in phantom lines in FIG. 1.

The clamping member is biased toward the release position by a resilient biasing means in the form of a coil spring 64 disposed in a cutout 66 formed within the clamping member. The opposite ends 68 and 70 of the spring are disposed within the clamping member and the handle respectively, the spring urging the clamping member toward the phantom line position as shown in FIG. 1.

The outer surface of the clamping member may be of substantially the same curvature as the outer surface of the handle, so that in the full line clamping position as shown in FIG. 1, the outer surface of the clamping member is substantially flush with the outer surface of the handle. This facilitates grasping of the clamping member and the adjacent portion of the handle by the hand of a water skier when the device is in use.

A portion of a harness worn by a water skier is indicated by reference numeral 80 in FIG. 1. The harness may be of any suitable construction, and for example, may comprises a conventional wind surfing harness. Regardless of the particular type of harness employed, the harness includes a hook member 82 or similar construction for readily hooking the harness to the harness line so that the pull of the tow line may be transferred to the harness worn by the skier.

When using the harness release device shown in FIG. 1, the skier initially inserts end portion 34 of the harness line within the bore extending through the handle, and grasps the handle in one or both of his hands so that one hand grips around the clamping member which is thereby moved into clamping position. A motor boat or other means then applies pulling force to the tow line, and the pull will be transferred to the handle of the device. As long as the skier grasps the clamping member and holds it in the full line position shown in FIG. 1, the pull will also be transferred through the harness line to the harness if the harness line is in engagement with member 82 of the harness. The skier can hook or unhook the harness to the harness line as he desires.

If the skier has hooked the harness to the harness line as shown in FIG. 1 and falls down, he will release the handle, whereby the clamping member 56 moves under the influence of spring 64 into the phantom line position shown in FIG. 1. End portion 34 of the harness line is therefore free to slide outwardly of the bore in the handle, whereupon the harness line will be released from the portion 82 of the harness, and the skier is completely released from the tow line and the handle so that he will not be dragged through the water.

Figure 4:
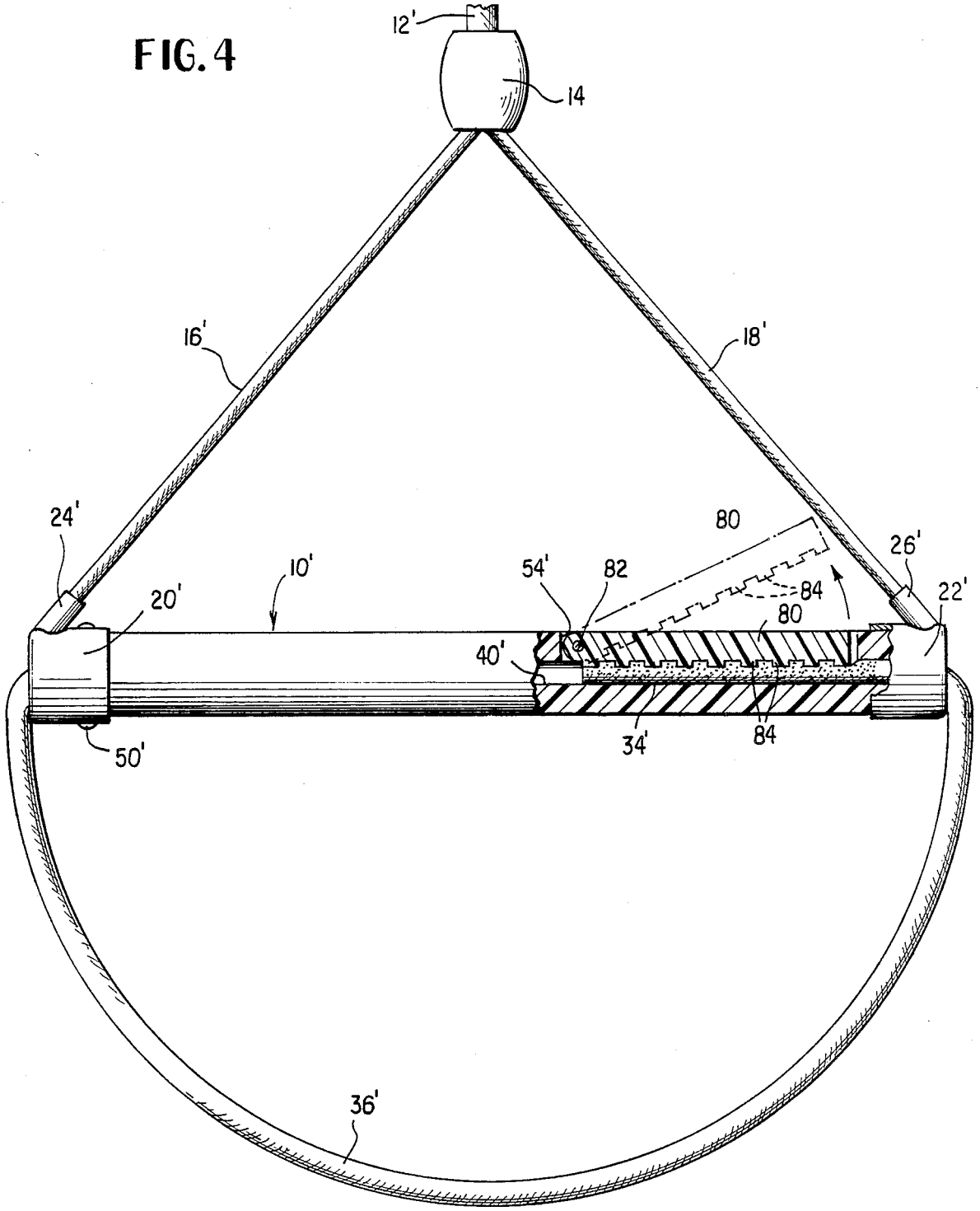
FIG. 4 is a top view, partly in section, of a modified form of the invention.

Referring now to FIG. 4 of the drawings, a modified form of the invention is shown wherein those components which are similar to those in shown in FIG. 1 have been given the same reference numeral primed. The only difference lies in the specific form of clamping means employed. In FIG. 4, the clamping member 80 may also be formed of plastic and is pivotally supported by a pivot pin 82 for pivotal movement into and out of slot 54'. In this case, the clamping member is pivoted at the opposite end from the arrangement shown in FIG. 1 so that the clamping member pivots into the phantom line position shown in FIG. 4, which is opposite to the manner in which the clamping member pivots in FIG. 1.

Clamping member 80 is provided with a plurality of spaced clamping portions 84 for engaging end portion 34' of the harness line. These clamping portions may comprise generally rectangular teeth having flat outer surfaces rather than the sharp outer edges of the teeth shown on the clamping member illustrated in FIG. 1.

The resilient biasing means of FIG. 1 has been eliminated in the form of the invention shown in FIG. 2. No such biasing means is necessary in this form of the invention due to fact that the force applied to the harness line when the harness line is connected to a harness pulls the end of the harness line outwardly of the bore in the handle with considerable force. When the skier releases the clamping member 80, the force of the end portion 34' of the harness line in moving outwardly of the bore in the handle tends to pivot the clamping member into the release position, thereby eliminating the necessity of providing any biasing means.

The invention has been described with reference to preferred embodiments. Obviously, modifications, alterations and other embodiments will occur to others upon reading and understanding this specification. It is my intention to include all such modification, alterations and alternate embodiments insofar as they come within the scope of the appended claims or the equivalent thereof.

What is claimed is:

1. A harness release device for water skiing comprising a substantially rigid handle for connection to a ski tow line and adapted to be grasped by the hands of a water skier, a harness line said harness line having opposite end portions, one of said end portions being fixedly secured to said handle so that said one end portion cannot move away from the handle, the other of said end portions being releasably connected to said handle, clamping means movably supported by said handle for movement into and out of a clamping position with respect to said other end portion, said clamping means when held by the hand of a skier being disposed in the clamping position to engage said other end portion to connect the handle with said other end portion, said clamping means when out of the clamping position being out of engagement with said other end portion and releasing said other end portion from said handle.

2. A device as defined in claim 1 including resilient means biasing said clamping means out of the clamping position.

3. A device as defined in claim 1 wherein said clamping means includes a plurality of spaced clamping portions for clamping said opposite end portion of the harness line.

4. A device as defined in claim 1 wherein said handle includes an outer surface, said clamping means including an outer surface which is substantially flush with the outer surface of the handle when the clamping means is in the clamping position.

5. A device as defined in claim 1 wherein said opposite end portion of said harness line is substantially stiffer than the remainder of the harness line.

6. A device as defined in claim 1 including securing means supported by said handle and extending through said one end portion of the harness line to secure said one end portion of the harness line to the handle.

7. A harness release device for water skiing comprising a substantially rigid handle for connection to a ski tow line and adapted to be grasped by the hands of a water skier, said handle having opposite end portions, said handle having a bore formed therethrough including a bore wall and opening at said opposite end portions, a harness line for connection to a harness adapted to be worn by a water skier, said harness line having opposite end portions, one end portion of said harness line being received within said bore at one end of said handle and being held against axial movement outwardly of said bore at all times during use of the device, the other of said end portions of said harness line being slidably received within said bore at the opposite end of the handle, clamping means pivotally mounted on said handle for pivotal movement into and out of engagement with said other end portion of said harness line, the clamping means being held in engagement with said other end portion of the harness line by the hand of a water skier to clamp said other end portion of the harness line between said clamping means and said bore wall to prevent sliding movement of said other end portion of the harness line relative to said handle, the clamping means being pivotable out of engagement with said other end portion of the harness line to allow said other end portion of the harness line to slide out of said bore.

8. A device as defined in claim 7 including resilient means biasing said clamping means out of engagement with said other end portion of the harness line.

9. A device as defined in claim 7 wherein said clamping means includes a plurality of spaced clamping portions for clamping said opposite end portion of the harness line.

10. A device as defined in claim 7 wherein said handle includes an outer surface, said clamping means including an outer surface which is substantially flush with the outer surface of the handle when the clamping means is in engagement with said other end portion of the harness line.

11. A device as defined in claim 7 wherein said opposite end portion of said harness line is substantially stiffer than the remainder of the harness line.

12. A device as defined in claim 7 including securing means supported by said handle and extending through said one end portion of the harness line to secure said one end portion of the harness line to the handle.

13. A harness release device for water skiing comprising a substantially rigid handle for connection to a ski tow line and adapted to be grasped by the hands of a water skier, said handle having opposite ends and a longitudinal bore extending therethrough and opening at the opposite ends of said handle, said bore defining a bore wall, a longitudinal slot formed in said handle and being in communication with said bore, clamping means pivotably supported by said handle and being pivotable into and out of said slot, a harness line for connection to a harness adapted to be worn by a water skier, said harness line having opposite end portions, one end portion of said harness line being received in one end of said bore, means for securing said one end portion in place within said one end of said bore, the opposite end portion of said harness line being received in the opposite end of said bore and being positioned adjacent said slot, said clamping means comprising an elongated member engageable with a substantial length of said other end portion of the harness line and clamping said other end portion of the harness line between said member and said bore wall to prevent movement of said other end portion of the harness line out of said bore.

14. A device as defined in claim 13 including resilient means biasing said clamping means out of engagement with said other end portion of the harness line.

15. A device a defined in claim 13 wherein said clamping means includes a plurality of spaced clamping portions for clamping said opposite end portion of the harness line.

16. A device as defined in claim 13 wherein said handle includes an outer surface, said clamping means including an outer surface which is substantially flush with the outer surface of the handle when the clamping means is in engagement with said other end portion of the harness line.

17. A device as defined in claim 13 wherein said opposite end portion of said harness line is substantially stiffer than the remainder of the harness line.

18. A device as defined in claim 13 including securing means supported by said handle and extending through said one end portion of the harness line to secure said one end portion of the harness line to the handle.

* * * * *